US006882092B1

(12) United States Patent
Nguyen

(10) Patent No.: US 6,882,092 B1
(45) Date of Patent: Apr. 19, 2005

(54) JET NOZZLE SPARK PLUG

(76) Inventor: Bill Nguyen, 16536 Avalon Blvd., Carson, CA (US) 90746

( * ) Notice: Subject to any disclaimer, the term of this patent is extended or adjusted under 35 U.S.C. 154(b) by 0 days.

(21) Appl. No.: 10/618,774

(22) Filed: Jul. 14, 2003

Related U.S. Application Data

(60) Provisional application No. 60/471,755, filed on May 20, 2003.

(51) Int. Cl.[7] ..... H01T 13/20

(52) U.S. Cl. ..... 313/141; 313/125; 313/143; 313/144

(58) Field of Search ..... 313/123, 125, 313/141, 142, 143, 144

(56) References Cited

U.S. PATENT DOCUMENTS 5,051,651 A * 9/1991 Kashiwara et al. ..... 313/139
5,103,136 A * 4/1992 Suzuki et al. ..... 315/59
6,670,740 B1 * 12/2003 Landon, Jr. ..... 313/141

* cited by examiner

*Primary Examiner*—Joseph Williams
*Assistant Examiner*—Kevin Quarterman
(74) *Attorney, Agent, or Firm*—Roger A. Marrs

(57) ABSTRACT

A spark plug having a ground electrode in the shape of a horn nozzle defined by an enlarged mouth and a reduced throat joined together, a conical inner wall tapered from the mouth to the throat. An ignitor electrode terminates at its distal end in a spherical tip disposed in the throat in spaced-apart relationship with respect to the tapered inner wall. An insulative body supports the ignitor electrode with a conductive body supporting the ground electrode. The horn nozzle is joined with the conductive body by a pair of posts so as to define a pair of slots for venting exhaust gasses from the ignition site.

2 Claims, 2 Drawing Sheets

JET NOZZLE SPARK PLUG

Priority claimed on Ser. No. 60/471,755 filed May 20, 2003 abandoned.

BACKGROUND OF THE INVENTION

1. Field of the Invention

The present invention relates to the field of spark plugs for internal combustion engines, and more particularly to a novel spark plug having a horn nozzle at its discharge end providing a narrow throat creating more concentrate of a fuel/air mixture than can be gained from conventional spark plugs.

2. Brief Description of the Prior Art

Spark ignition of an air/fuel mixture within a combustion chamber of an internal combustion engine involves the igniting of the mixture by an electric spark, closing a gap between an electrode, providing the spark and a ground electrode. Thus, in general, upon a downward stroke of a piston within a cylinder, the fuel/air mixture enters the combustion chamber from the carburetor or fuel injection system. Additional fuel/air mixture is then blocked-off upon completion of the compression stroke of the piston and simultaneously a spark is emitted across the spark gap causing combustion of the fuel/air mixture. This combustion and the expanding gasses provides the power stroke of the piston.

Problems and difficulties have been encountered with conventional spark plugs which stem primarily from the fact that none have been able to obtain ultimate performance by providing better mixing of the fuel and air together so that better ignition and more uniform and efficient burning is obtained in the combustion chamber. A part of the problem resides in that the surface area of the igniting electrode is limited and, therefore, the life of the igniting electrode as well as the ground electrode is limited and short lived. Furthermore, the spark crossing the gap follows a linear path which again limits ignition and the conductive path between electrodes.

Therefore, a long-standing need has existed to provide a novel spark plug having a maximum discharge area on the igniting electrode and further having an expanded area on the ground electrode so that the spark traveling through the gap is not constricted or restricted as described above.

SUMMARY OF THE INVENTION

Accordingly, the above problems and difficulties are avoided by the present invention which provides a spark plug having an insulated ignitor electrode, terminating in a spherical tip that provides an enlarged overall surface area from which a spark is discharged. The spark plug further includes a ground electrode having a horn nozzle with a central opening occupied by the spherical tip of the ignitor electrode in fixed, spaced-apart relationship. The horn nozzle further includes an inner wall which is of a diverging taper shape from the distal end of the nozzle towards the central opening. Preferably, the tapered wall surface is rounded and the nozzle, central opening, and the ignitor electrode are concentrically arranged at the end of the spark plug. The horn nozzle is carried on the end of the spark plug by a pair of posts which separate the horn nozzle from the end of the spark plug by a pair of slots for venting the area upon ignition.

By providing a horn nozzle with a tapered inner wall, a central opening creates a narrow throat for concentrating the fuel/air mixture faster upon ignition permitting the horizontal slots between the ground electrode and the end of the spark plug to vent burned gasses.

Therefore, it is among the primary objects of the present invention to provide a jet nozzle spark plug having a horn nozzle shaped face creating a narrow throat for providing a concentrate of fuel/air mixture in a shorter time in which to cause ignition while burnt gasses are removed from the area in a faster manner by means of venting slots.

Still a further object of the present invention is to provide a spark plug having a ground electrode formed in a horn nozzle shape with a diverging inner wall terminating in an opening in spaced relationship to an ignition electrode which provides a substantially greater surface area between the ground electrode and the ignitor electrode than conventional spark plugs.

Another object of the present invention is to provide a super jet spark plug having a ground electrode with a horn nozzle shape in spaced relationship to a spherically tipped ignitor electrode in order to burn a fuel/air mixture extremely fast so as to provide fuel efficiency and to burn clean.

Still a further object is to provide a spark plug discharging set of electrodes wherein the spark generated by the ignitor electrode passes to the ground electrode which is of a horn shape so as to burn mixed gasses and which is capable of generating a large volume ignition in a relatively short period of time in order to burn the mixed gasses very quickly whereby power is increased and the burn is clean and fuel efficiency is gained.

BRIEF DESCRIPTION OF THE DRAWINGS

The features of the present invention which are believed to be novel are set forth with particularity in the appended claims. The present invention, both as to its organization and manner of operation, together with further objects and advantages thereof, may best be understood with reference to the following description, taken in connection with the accompanying drawings in which:

DESCRIPTION OF PREFERRED EMBODIMENT

Figure 1:
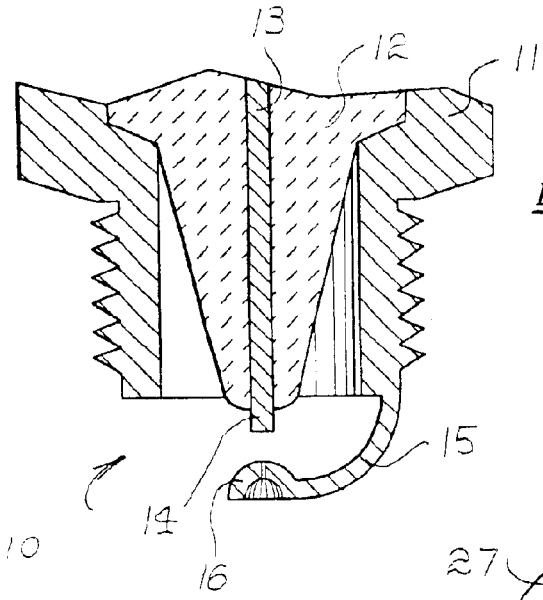
FIG. 1 PRIOR ART
FIG. 1 is an enlarged sectional view of a conventional spark plug having an ignitor electrode and a ground electrode.

Referring to FIG. 1, a conventional tip of a spark plug is illustrated in the general direction of arrow 10 which includes a body 11 supporting an insulator 12 which, in turn, supports an ignitor electrode 13. It can be seen that the electrode 13 terminates at its distal end in a cylindrical tip 14 and that the tip is in fixed, spaced-apart relationship with respect to a ground electrode 15. The ground electrode 15 terminates at its distal end in a knob 16 which is fixed, spaced-apart relationship with respect to the tip 14 of the ignition electrode. Therefore, a substantial gap is defined between the two electrodes. However, it can be seen that the relative surface area of the electrodes is limited to the cylindrical shape of the tip 14 and the knob 16. Therefore, since only a limited surface area is available, extensive wear and debris build-up occurs rapidly. As the build-up continues, efficiency decreases.

Figure 2:
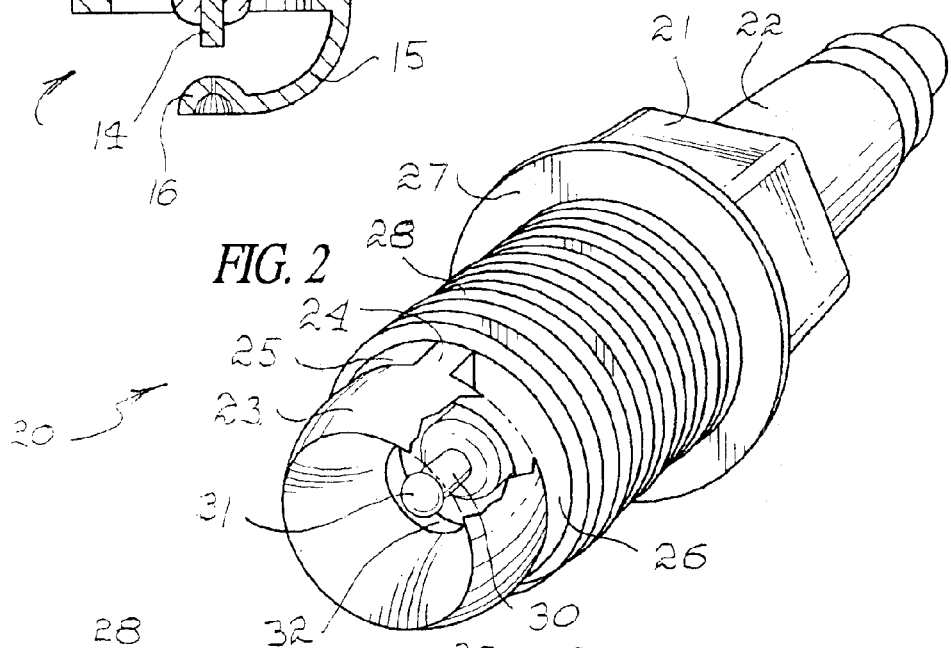
FIG. 2 is a perspective view of the novel jet nozzle spark plug incorporating the present invention.

Referring now in detail to FIG. 2, it can be seen that the jet nozzle spark plug incorporating the present invention is indicated in the general direction of arrow 20 and includes an elongated body 21 which supports an insulated inner body 22. The outer body 21 terminates at one end in a horn nozzle 23 which is joined to the main body by a pair of posts, such as post 24, with the other post of the pair on the opposite side. The pair of posts define horizontal slots 25 and 26 which serve as venting slots for expanded, ignited gasses. A washer 27 is disposed around the outer body and the outer body further includes a set of threads 28 for threaded attachment with a bore in the cylinder of an engine.

The horn nozzle is a ground electrode, while an ignitor or ignition electrode is indicated by numeral 30 and is supported by the insulator inner body 22. A distal end of the ignitor electrode 30 terminates in a sphere 31 and is disposed in a central opening 32 of the horn nozzle.

Figure 3:
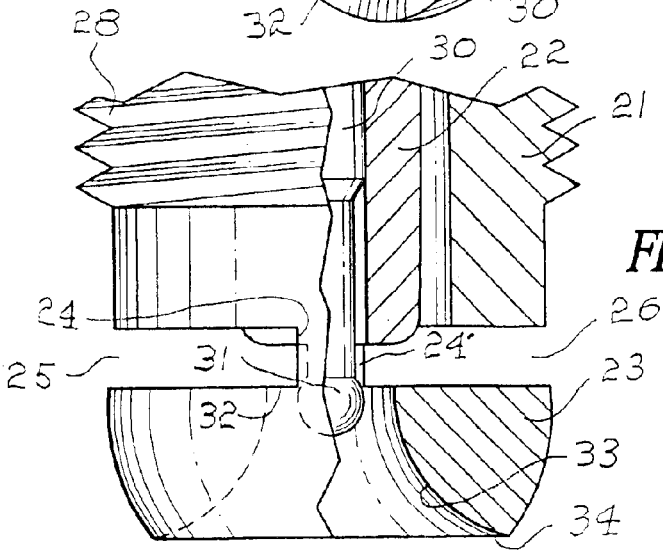
FIG. 3 is an enlarged side elevational view of the electrodes in the spark plug shown in FIG. 2 and partially in section to illustrate components thereof.

Referring now in detail to FIG. 3, it can be seen that the horn nozzle 23 includes a rounded, tapered inner surface 33 which diverges from a mouth 34 towards the ignitor electrode 30 to terminate at the opening 32. Also, it is to be noted that the spherical tip 31 on electrode 30 partially occupies the opening 32 and is disposed in fixed, spaced-apart relationship with respect to the narrowest end of the horn nozzle. The inner wall 33 is conical in cross-section configuration, having the reduced end at opening 32 and the expanded "horn" at end or mouth 34. Also, the posts supporting the horn nozzle to the body 21 are indicated on one side by numeral 24 and at its opposite side by numeral 24'.

Figure 4:
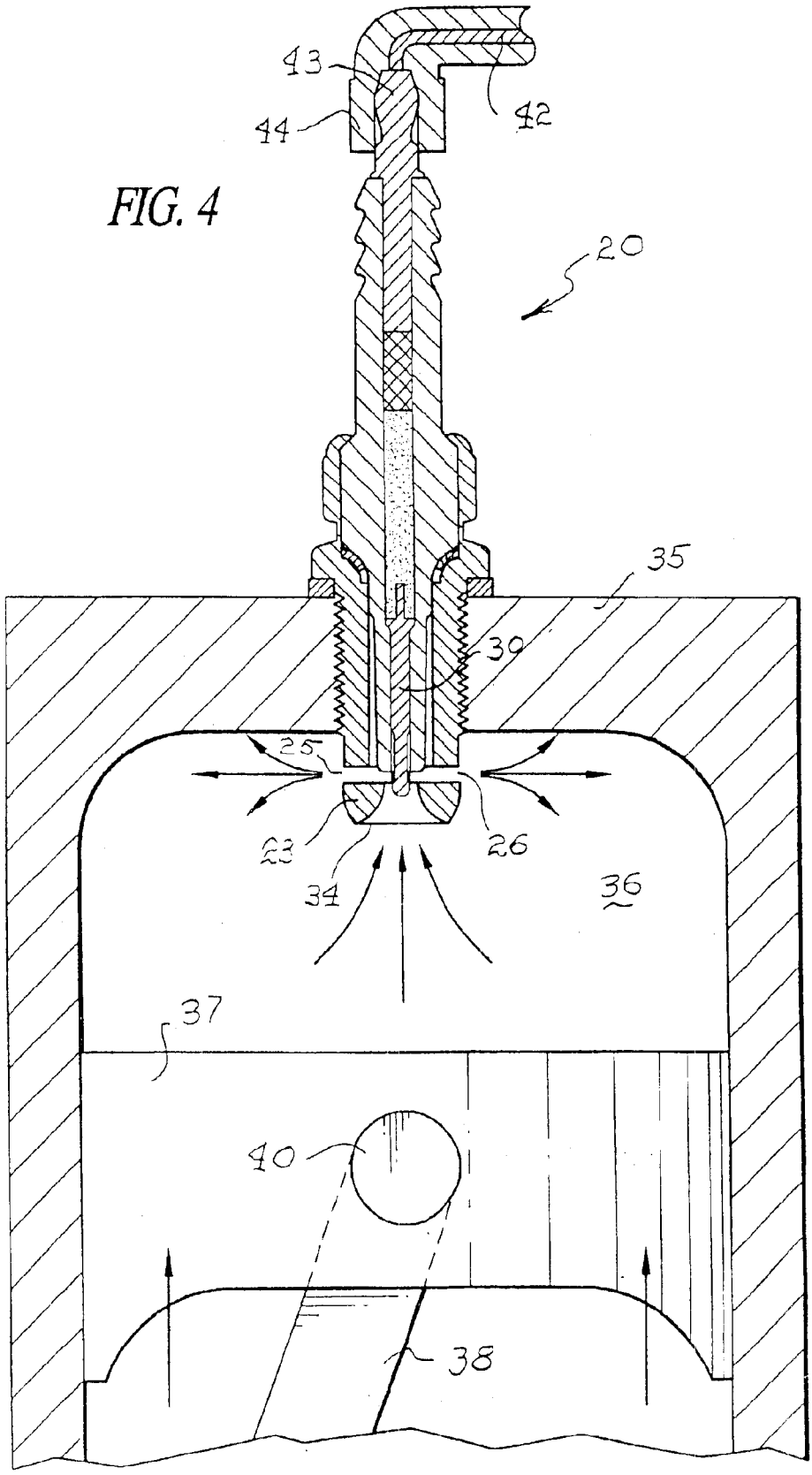
FIG. 4 is a longitudinal sectional view of the spark plug incorporating the present invention and illustrated as installed in a cylinder having a working piston therein.

Referring now in detail to FIG. 4, it can be seen that the jet nozzle spark plug 20 is threadably mounted on a cylinder 35 so that the spark creating end of the spark plug is within the combustion chamber of the cylinder. A piston 37 is illustrated which is moved up and down within the cylinder by a piston rod 38 having a pivot attachment 40 to the piston.

As fuel is introduced into the piston chamber, fuel and air are mixed within the combustion chamber 36 and compressed on the up-stroke of the piston 37. The compressed fuel/air mixture is ignited by means of an electrical impulse provided by ignition wire 42 which is connected to the ignitor electrode by press fittings 43 and 44.

At the time of the compression cycle, the piston forces the fuel/air mixture to travel through the horn nozzle so that the fuel/air mixture enters with a larger volume from the mouth of the horn nozzle while digressing in smaller volume to the smaller or reduced throat at central opening 32. Upon ignition, the exhaust gasses escape from the nozzle via the venting slots 25 and 26 while traveling through the horn nozzle and gathering speed at the throat 32. More mixed gasses concentration provides sensitivity to ignition and prepares for the next ignition or explosion cycle.

At the proper time, the spark plug discharging between the ignitor or central electrode 31 and the ground-horn nozzle 23 burns the mixed gasses so that explosion occurs and generates an enlarged fire jet through the vent slots at great speed. The burned mixed gasses in the cylinder greatly increase power, burn clean, and the engine performs with better fuel efficiency. A reverse flow occurs through vents preparatory to ignition.

Therefore, it can be seen that the horn nozzle providing the tapered passageway between the mouth and throat of the opening provides substantial area presented to the spherical tip 31 for conducting an ignition spark therebetween. The two electrodes are in spaced-apart relationship and adjustment with respect to centering and coaxial displacement of the ignitor electrode 30 can be achieved by bending the tip with a proper tool. In the prior art illustration of FIG. 1, it is noted that the ground electrode 15 is adjustable by bending, while the ignitor electrode 14 is not pliable nor bendable.

While particular embodiments of the present invention have been shown and described, it will be obvious to those skilled in the art that changes and modifications may be made without departing from this invention in its broader aspects and, therefore, the aim in the appended claims is to cover all such changes and modifications as fall within the true spirit and scope of this invention.

What is claimed is:

1. A spark plug for the controlled burning of a fuel/air mixture at a defined burn zone within a combustion chamber in the cylinder of an internal combustion engine comprising:

an elongated electronically non-conductive body;

an ignitor electrode supported by said non-conductive body and having a distal tip extending into said burn zone;

an elongated conductive body surrounding said non-conductive body and having a horn nozzle immediately adjacent said tip in spaced-apart relationship;

at least one post joining said horn nozzle with said conductive body and to hold said horn nozzle in spaced-apart relationship with respect to said conductive body to define said burn zone;

vent slots provided in said burn zone by said posts for exhausting gasses therethrough exteriorly of said horn nozzle;

said horn nozzle is circular having a conical inner side wall terminating adjacent said tip in a reduced throat diameter and terminating exteriorly with an enlarged mouth of greater diameter than the diameter of said throat diameter;

said side wall constituting an open-ended flared frustum-conical passageway having a curved surface in transverse cross section;

said distal tip of said ignitor electrode is spherical and resides within said throat of said horn nozzle defining an annular linear entrance leading into said throat; and said ignitor electrode bendable for adjustment with respect to distance from said horn nozzle with said throat.

2. A spark plug for the controlled burning of a fuel/air mixture at a defined burn zone within a combustion chamber in the cylinder of an internal combustion engine comprising:

a non-conductive body;

a conductive body supporting said non-conductive body;

an ignitor electrode carried by said non-conductive body having an exposed distal tip of rounded configuration;

a ground electrode supported by said conductive body and having a horn nozzle with an frustum-conical passageway defined by a tapered inner wall leading from a mouth to a throat partially encircling said distal tip of said ignitor electrode;

a pair of posts integrally connecting said non-conductive body with said horn nozzle to define venting slots between said conductive body and said horn nozzle; and said mouth commencing with a linear annular opening downwardly merging with a bell-shaped side wall.

* * * * *